US010641544B2

(12) United States Patent
Choi

(10) Patent No.: US 10,641,544 B2
(45) **Date of Patent: *May 5, 2020**

(54) REFRIGERATOR

(71) Applicant: LG ELECTRONICS INC., Seoul (KR)

(72) Inventor: Daejin Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,408

(22) Filed: May 22, 2019

(65) Prior Publication Data

US 2019/0271499 A1 Sep. 5, 2019

Related U.S. Application Data

(63) Continuation of application No. 15/764,073, filed as application No. PCT/KR2016/011084 on Oct. 4, 2016, now Pat. No. 10,302,351.

(30) Foreign Application Priority Data

Oct. 2, 2015 (KR) ..... 10-2015-0138978

(51) Int. Cl.
*F25D 23/04* (2006.01)
*F25D 23/02* (2006.01)
(Continued)

(52) U.S. Cl.
CPC ..... *F25D 23/04* (2013.01); *E05D 15/00* (2013.01); *F25D 11/02* (2013.01); *F25D 23/02* (2013.01);
(Continued)

(58) Field of Classification Search
CPC ..... F25D 23/04; F25D 23/028; F25D 23/021; F25D 23/069; F25D 25/02; F25D 25/005; F25D 2400/04
See application file for complete search history.

(56) References Cited

U.S. PATENT DOCUMENTS 10,302,351 B2 * 5/2019 Choi ..... F25D 23/02
2011/0095670 A1 * 4/2011 Cho ..... F25D 25/025 312/405.1
(Continued)

FOREIGN PATENT DOCUMENTS

EP 2 594 877 5/2013
JP 2006-112644 4/2006
(Continued)

OTHER PUBLICATIONS

European Search Report dated May 10, 2019 issued in Application No. 16852145.8.
International Search Report and Written Opinion dated Dec. 14, 2016 dated in Application No. PCT/KR2016/011084 (with English translation).
U.S. Notice of Allowance dated Jan. 18, 2019 issued in related co-pending U.S. Appl. No. 15/764,073.

*Primary Examiner* — Daniel J Rohrhoff
(74) *Attorney, Agent, or Firm* — KED & Associates LLP

(57) ABSTRACT

The present invention relates to a refrigerator having a structure of a receptacle apparatus, which enables efficient utilization of a space for storing an object to be refrigerated or an object to be frozen, and a door or a cover which is for opening or closing the receptacle apparatus. Provided is a refrigerator, according to an embodiment of the present invention, comprising: a first storage chamber provided above a cabinet; a second storage chamber positioned below the first storage chamber; a partition wall which is for partitioning the first storage chamber and second storage chamber vertically and of which the upper surface maintains a level position; an accommodation unit recessed downward from the upper side of the partition wall, forming a receptacle space and having an input port, into which an object to
(Continued)

be stored is input, formed on the upper part thereof; an accommodation unit door provided so as to be movable in the direction parallel to the upper side of the partition wall and for selectively opening or closing the input port; and a position fixing unit provided on the rear of the accommodation unit door and for restraining the movement of the door when the accommodation unit door moves backward and opens the input port.

20 Claims, 8 Drawing Sheets

(51) Int. Cl.

| | |
|---|---|
| ***F25D 25/02*** | (2006.01) |
| ***E05D 15/00*** | (2006.01) |
| ***F25D 11/02*** | (2006.01) |
| ***F25D 23/06*** | (2006.01) |
| ***F25D 25/00*** | (2006.01) |

(52) U.S. Cl.
CPC ..... *F25D 23/069* (2013.01); *F25D 25/005* (2013.01); *F25D 25/02* (2013.01); *F25D 25/024* (2013.01); *E05Y 2900/31* (2013.01); *F25D 2323/021* (2013.01); *F25D 2323/024* (2013.01); *F25D 2400/04* (2013.01)

(56) References Cited

U.S. PATENT DOCUMENTS

| | | | | |
|---|---|---|---|---|
| 2013/0127322 | A1* | 5/2013 | Seo | F25D 23/069 312/404 |
| 2014/0117831 | A1* | 5/2014 | Lee | F25D 25/025 312/408 |
| 2015/0059399 | A1* | 3/2015 | Hwang | F25D 25/025 62/441 |
| 2015/0115790 | A1* | 4/2015 | Ogg | F25D 23/069 312/404 |
| 2015/0241117 | A1* | 8/2015 | Burke | F25D 23/065 312/404 |
| 2017/0115051 | A1* | 4/2017 | Ramm | F25D 25/025 |

FOREIGN PATENT DOCUMENTS

| | | |
|---|---|---|
| KR | 10-2005-0057995 | 6/2005 |
| KR | 10-2006-0049687 | 5/2006 |
| KR | 10-0974794 | 8/2010 |
| KR | 10-2011-0046237 | 5/2011 |
| KR | 10-2013-0055177 | 5/2013 |

* cited by examiner (A)

(B)

REFRIGERATOR

This application is a Continuation of U.S. patent application Ser. No. 15/764,073, filed Mar. 28, 2018, which is a U.S. National Stage Application under 35 U.S.C. § 371 of PCT Application No. PCT/KR2016/011084, filed Oct. 4, 2016, which claims priority to Korean Patent Application No. 10-2015-0138978, filed Oct. 2, 2015, whose entire disclosures are hereby incorporated by reference.

TECHNICAL FIELD

The present invention relates to a refrigerator, and more particularly to a receiving unit configured to efficiently utilize space for storing objects to be refrigerated or frozen and structures of a door and a cover for opening and closing the receiving unit.

BACKGROUND ART

A refrigerator is an apparatus for storing storage objects (objects to be refrigerated or frozen) received in a storage space in a refrigerated or frozen state through a cycle constituted by compression, condensation, expansion and evaporation of refrigerant. In other words, a conventional refrigerator is provided with a storage space for receiving storage objects and a heat exchange unit for absorbing heat from the air in the storage space so as to maintain the storage objects disposed in the storage space at a temperature lower than the ambient temperature.

Because the volume of the storage space is restricted by the storage capacity set for the refrigerator, designing the storage space to be efficiently utilized is one of the critical factors in the design of a refrigerator.

For efficient utilization of the storage space, a conventional refrigerator is provided therein not with a space for receiving storage objects but with a drawer configured to be put into and taken out of the storage space and shelves for supporting the storage objects.

Because the storage space provided in the refrigerator is partitioned by drawers, shelves or the line in consideration of the volume of storage objects, the number or the volume of receiving components (shelves, drawers and the like) capable of being mounted in the storage space having the maximum volume, which is determined according to the capacity of the refrigerator, is inevitably restricted.

This means that some of the drawers and shelves have to be omitted, the volume of the drawers has to be reduced, or the distance between the shelf and the drawer or the distance between the shelves has to be reduced in order to add additional receiving component space to the storage space in the refrigerator. The reason for this is because, in order to add a new receiving component, a portion of the storage space has to be used as a space required to accommodate installation of the receiving component.

However, a change of design in which the number or the volume of drawers and shelves is reduced for installation of a new receiving component may cause a problem whereby the drawers or shelves cannot accommodate the amount of storage objects that is determined at the time of design, thereby decreasing storage efficiency.

In addition, because a change of design in which the number or the volume of drawers and shelves is reduced for installation of a new receiving component is no different from the design of a new storage space, it is difficult to add a new receiving component to a conventional refrigerator while maintaining the volume of the storage space that is already designed.

DISCLOSURE

Technical Problem

The present invention is intended to solve the above-described problems with a conventional refrigerator.

An embodiment of the present invention is intended to provide a receiving unit capable of minimizing the amount of space required for installation and a refrigerator including the receiving unit.

An embodiment of the present invention is intended to provide a receiving unit provided in a partition wall, configured to isolate storage spaces from each other, so as to provide additional storage space without reducing the size of a predetermined space for receiving storage objects, and a refrigerator including the receiving unit.

An embodiment of the present invention is intended to provide a refrigerator designed to facilitate manipulation of a door for opening and closing a receiving unit and to minimize the amount of space required for manipulation of the door, thereby minimizing a reduction in amount of the storage space in the refrigerator.

An embodiment of the present invention is intended to provide a receiving unit designed to provide a door with restoring force so as to open and close an introduction port of a receiving unit and designed to reduce the speed of movement of a door for opening and closing an introduction port from the time the door passes over a specific point of the introduction port, and a refrigerator including the receiving unit.

An embodiment of the present invention is intended to provide a receiving unit capable of preventing foreign substances from entering a transfer unit for actuating a door and a refrigerator including the receiving unit.

An embodiment of the present invention is intended to provide a receiving unit including a guide for guiding movement of a door for opening and closing an introduction port of the receiving unit so as to enable the door to be stably actuated and a refrigerator including the receiving unit.

An embodiment of the present invention is intended to provide a refrigerator in which a door for opening and closing an introduction port of a receiving unit is configured to be moved anteroposteriorly and horizontally, thereby making it convenient to use the refrigerator. Particularly, the embodiment is intended to provide a refrigerator having an attractive design in which components for guiding or supporting movement of the door are positioned at a rear side and/or opposite lateral edges of the door.

Technical Solution

In order to achieve the objects, according to an embodiment of the present invention, a refrigerator includes a first storage compartment positioned at an upper side of a cabinet; a second storage compartment positioned below the first storage compartment; a partition wall configured to isolate the first storage compartment from the second storage compartment upwards and downwards and to have a horizontal upper surface; a receiver including a receiving space depressed downwards from the upper surface of the partition wall and an introduction port formed in an upper portion thereof so as to allow storage objects to be introduced into the receiving space therethrough; a receiver door configured to be moved in a direction parallel to the upper surface of the partition wall so as to selectively open or close the introduction port; and a position holder provided behind the receiver door so as to restrict movement of the door when the receiver door is moved so as to open the introduction port.

In order to achieve the objects, according to an embodiment of the present invention, a refrigerator includes a first storage compartment positioned at an upper side of a cabinet; a second storage compartment positioned below the first storage compartment; a partition wall configured to isolate the first storage compartment from the second storage compartment upwards and downwards and to have a horizontal upper surface; a receiver including a receiving space depressed downwards from the upper surface of the partition wall and an introduction port formed in an upper portion thereof so as to allow storage objects to be introduced into the receiving space therethrough; a receiver door configured to be moved in a direction parallel to the upper surface of the partition wall so as to selectively open or close the introduction port; a pair of transfer units, which are respectively provided at lateral side ends of the partition wall so as to guide movement of the receiver door, the pair of transfer units being configured to provide restoring force when the receiver door is opened and to reduce a moving speed of the receiver door; and a guide disposed between the pair of transfer units so as to guide movement of the receiver door.

In order to achieve the objects, according to an embodiment of the present invention, a refrigerator may include a first space compartment having a space for receiving therein an object to be refrigerated or frozen; a second space compartment positioned below the first storage compartment and having a space for receiving therein an object to be refrigerated or frozen; a partition wall configured to isolate the first space from the second space; a receiver including a space depressed from the surface of the partition wall so as to receive an object to be refrigerated or frozen; a receiver door configured to be moved in a direction parallel to the surface of the partition wall so as to open or close the receiver; an elastic-force provider for providing the receiver door with restoring force when the door is moved in order to open the receiver; and a transfer unit including a speed controller for reducing a moving speed of the door when the door is moved to close the receiver.

The transfer units may be provided at opposite lateral ends of the receiver door so as to face each other.

The receiver may include a receiver body, and may be coupled to an upper portion of the partition wall. The receiver may include an introduction port formed in an upper portion thereof. The receiver door may be configured to be moved anteroposteriorly at a position above the introduction port so as to open and close the introduction port. Accordingly, a direction in which an object is put into and taken out of the receiver may be perpendicular to a direction of movement of the receiver door.

By virtue of the direction of movement of the receiver door, it is possible to minimize a reduction in the amount of storage space.

According to an embodiment of the present invention, the refrigerator may further include a guide disposed between the pair of transfer units so as to guide movement of the receiver door.

The guide may include a roller rotatably secured to the door; and a roller-receiving groove provided in the body in a direction parallel to a direction of movement of the door so as to receive the roller.

According to an embodiment of the present invention, the refrigerator may include a support wall projecting from a surface of the body so as to be parallel to a direction of movement of the door; and a roller rotatably provided at the door so as to come into contact with the support wall.

The refrigerator may further include a cover projecting toward the door from the support wall so as to define a space for receiving a peripheral edge of the door.

According to an embodiment of the present invention, the refrigerator may include a position holder for maintaining a state in which the receiver door opens the receiver.

The position holder may include a coupling body secured to the receiver door; a coupling protrusion provided at one of the coupling body and the partition wall; and a coupling grab provided at one of the coupling body and the partition wall so as to be removably coupled to the coupling body through engagement with the coupling protrusion. When the coupling body and the coupling grab are coupled to each other via the coupling protrusion, movement of the receiver door is restricted. Upon release of the coupling, the receiver door may be moved by force applied by a user or elastic restoring force.

The coupling grab may be configured to be repeatedly engaged with the coupling protrusion and released from the coupling protrusion whenever external force is applied to the coupling grab.

The refrigerator may include a roller rotatably secured to the coupling body; and a roller-receiving groove provided in the body in a direction parallel to a direction of movement of the door so as to receive the roller, and the coupling body may be disposed between the pair of transfer units.

The transfer unit may include a support provided in a direction parallel to a direction of movement of the door and secured to one end of the elastic-force provider; a slider, which is movable along the support and is coupled to the door, the slider being secured to a remaining end of the elastic-force provider, and the speed controller may include a cylinder secured to the support; a piston disposed at one end thereof in the cylinder and connected at a free end thereof to the slider; and a head secured to the one end of the piston and disposed in the cylinder.

The transfer unit may include a support secured to the body and to one end of the elastic-force provider; a transfer space provided in the support so as to be parallel to a direction of movement of the door; a first slider movable in the transfer space; and a second slider removably provided at the first slider and connected to the door, the second slider being coupled to a remaining end of the elastic-force provider, and the speed controller may include a cylinder secured to the support; a piston disposed in the cylinder and connected at a free end thereof to the first slider; and a head secured to one end of the piston and disposed in the cylinder. The second slider may be moved in a state of being secured to the first slider when the first slider is moved in a predetermined moving range of the free end, and may be separated from the first slider when the first slider is moved beyond the predetermined moving range of the free end.

An example of the present invention may include a first stopper and a second stopper, which are provided at the first slider so as to define a space for receiving the second slider; a first support and a second support, which are provided in the transfer space so as to define a moving path of the first slider; and a height controller configured to lower the first stopper, which is positioned in a direction in which the second slider is separated from the first slider, to a position lower than the first support and the second support when the free end of the piston reaches a reference point which is set be a point in the moving range.

The height controller may include a first projection, which projects from the first slider so as to cause the first slider to be supported by the first support; a second projection, which projects from the first slider so as to cause the first slider to be supported by the second support; a first receiving groove disposed at a position lower than the first support so as to receive the first projection therein; a second receiving groove disposed at a position lower than the second support so as to receive the second projection therein; a first sloped portion inclined downwards toward the first receiving groove from the first support so as to cause the first projection to be positioned in the first receiving groove when the free end of the piston reaches the reference point; and a second sloped portion inclined downwards toward the second receiving groove from the second support so as to cause the second projection to be positioned in the second receiving groove when the free end of the piston reaches the reference point.

The reference point may be set to a point at which the door is positioned between a point at which the door begins to close the receiver and a point at which the door closes the receiver by 50%.

The reference point may be set to a point at which the door is positioned between a point at which the door closes the receiver by 50% or more and a point at which the door closes the receiver by 90%.

An embodiment of the present invention may further include a first side wall and a second side wall, which define the transfer space; a first transfer groove formed in the first side wall in a direction of movement of the door; a second transfer groove formed in the second side wall in a direction of movement of the door; a first slider guide, which projects from the first slider and is fitted into the first transfer groove; and a second slider guide, which projects from the first slider and is fitted into the second transfer groove.

An embodiment of the present invention may further include an insulator disposed at a lower surface of the body so as to thermally isolate the first space from the second space, and the receiver may be provided in the insulator.

The features of the above embodiments may also be applied to other embodiments as long as they are not contradictory or exclusive to the other embodiments.

Advantageous Effects

According to an embodiment of the present invention, it is possible to provide a receiving unit capable of minimizing a space required for installation and a refrigerator including the receiving unit.

According to an embodiment of the present invention, it is possible to provide a receiving unit provided in a partition wall, configured to isolate storage spaces from each other, so as to provide an additional storage space without reducing a predetermined space for receiving storage objects, and a refrigerator including the receiving unit.

According to an embodiment of the present invention, it is possible to provide a refrigerator designed to facilitate manipulation of a door for opening and closing a receiving unit and to minimize an amount of space required for manipulation of the door, thereby minimizing a reduction in the amount of storage space in the refrigerator.

According to an embodiment of the present invention, it is possible to provide a refrigerator designed to provide a door having a restoring force so as to open and close an introduction port of a receiving unit. Furthermore, it is possible to provide a receiving unit configured to reduce the speed of movement of a door for opening and closing an introduction port from the time the door passes over a specific point of the introduction port, and a refrigerator including the receiving unit.

According to an embodiment of the present invention, it is possible to provide a receiving unit capable of preventing foreign substances from entering a transfer unit for actuating a door and a refrigerator including the receiving unit. Furthermore, it is possible to provide a refrigerator having an attractive appearance in which a receiving unit is mounted so as to be invisible to a user.

According to an embodiment of the present invention, it is possible to provide a receiving unit including a guide for guiding the movement of a door for opening and closing an introduction port of the receiving unit so as to enable the door to be stably actuated and a refrigerator including the receiving unit.

According to an embodiment of the present invention, it is possible to provide a refrigerator in which a door for opening and closing an introduction port of a receiving unit is configured to be moved anteroposteriorly and horizontally, thereby making it convenient to use the refrigerator. Particularly, it is possible to provide a refrigerator having an attractive design in which components for guiding or supporting the movement of the door are positioned at a rear side and/or opposite lateral edges of the door.

According to an embodiment of the present invention, it is possible to provide a refrigerator in which a door of a receiving unit is maintained in the open state when a user opens the door, thereby making it convenient to use the refrigerator.

BEST MODE

Hereinafter, preferred embodiments of the present invention, which is able to specifically achieve the above objects, will be described with reference to the accompanying drawings.

Unless otherwise specially indicated, all terms used in the specification are identical to general meanings of the terms understood by a person having ordinary skill in the art. If a term used in the specification conflicts with the general meaning of the term, the meaning should be understood to comply with the definition noted in the specification.

It should be noted herein that the construction of an apparatus, which will hereinafter be described, and a method of controlling the apparatus are given only for illustrative purposes, and the scope of protection of the invention is not limited thereto. Wherever possible, the same reference numbers will be used throughout the drawings to refer to the same or like parts.

Figure 1:
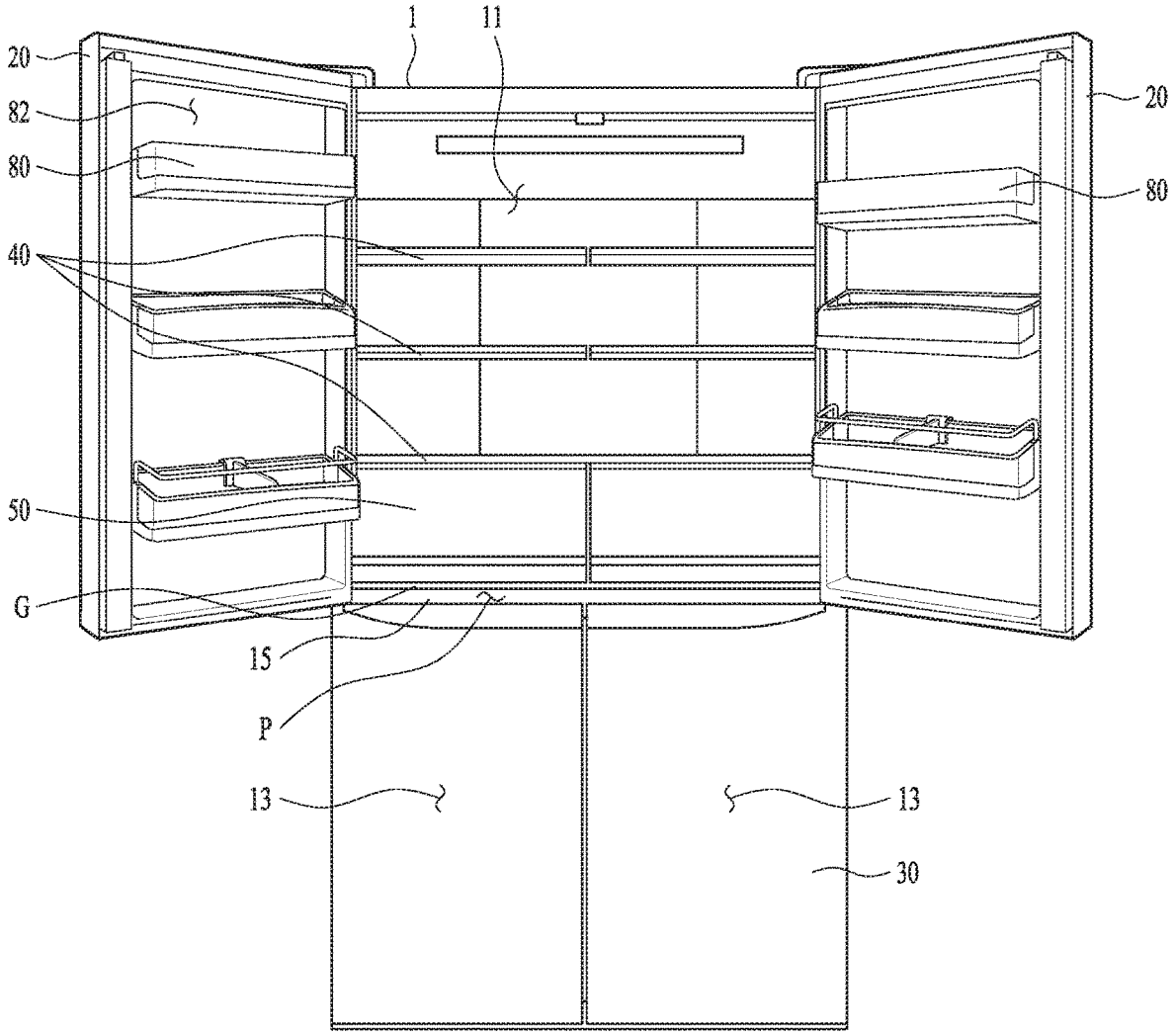
FIG. 1 illustrates a refrigerator according to an embodiment of the present invention.

FIG. 1 is a front view of a refrigerator according to an embodiment of the present invention, in which a storage compartment door is open.

The refrigerator according to the present invention may be applied to both a top-mount type refrigerator, in which a refrigerating compartment and a freezing compartment for storing foodstuffs are isolated from each other upwards and downwards and the freezing compartment is located above the refrigerating compartment, and a side-by-side type refrigerator, in which a freezing compartment and a refrigerating compartment are isolated from each other right and left.

However, this embodiment will be described with a focus on a bottom-freezer type, in which a refrigerating compartment and a freezing compartment are isolated from each other upwards and downwards and the freezing compartment is located below the refrigerating compartment, for convenience of explanation.

The refrigerator includes a case or a cabinet 1, which defines the overall appearance of the refrigerator when viewed from the outside by a user, and storage compartments 11 and 13, which are defined in the cabinet 1 so as to store foodstuffs.

The refrigerator includes doors 20 and 30 for opening and closing the storage compartments. The doors may include a freezing compartment door 30 and a refrigerating compartment door 20, each of which is rotatably coupled at one end thereof to the cabinet 1 of the refrigerator via a hinge. Each of the doors 30 and 20 may be composed of a plurality of doors. In other words, each of the refrigerating compartment door 20 and the freezing compartment door 30 may be composed of a pair of doors, which are configured to be opened forwards about opposite lateral sides of the refrigerator, as illustrated in FIG. 1.

The storage compartments 11 and 13 define insulated spaces, which are isolated from the outside by means of the doors 20 and 30. The storage compartments 11 and 13 may define insulated spaces, which are isolated from the outside when the doors 20 and 30 close the storage compartments 11 and 13. In other words, the storage compartments 11 and 13 may be considered as spaces, which are thermally isolated from the outside by means of the insulated walls constituted by the doors 20 and 30 and the insulated wall constituted by the cabinet 1.

Since cold air supplied from a machinery room is introduced into and circulated in the storage compartments 11 and 13, it is possible to maintain the foodstuffs stored in the storage compartments at a low temperature. In this embodiment, the storage compartment that is positioned at the upper side of the refrigerator may be referred to as a first storage compartment. For example, the first storage compartment may be the refrigerating compartment. The storage compartment that is positioned at the lower side of the refrigerator may be referred to as a second storage compartment. For example, the second storage compartment may be the freezing compartment. The first storage compartment may be composed of a single storage compartment, which is opened and closed by means of left and right doors 20, and the second storage compartment may be composed of a pair of storage compartments, which are isolated from each other right and left and are opened and closed by left and right doors 30.

The storage compartment 11 may be provided at the bottom thereof with a barrier or a partition wall 15. Specifically, the storage compartment 11 may be provided at the lower end thereof with the partition wall 15 so as to isolate the refrigerating compartment from the freezing compartment. The partition wall 15 may have a predetermined thickness and may extend horizontally.

The storage compartment 22 may include a shelf 40 on which foodstuffs are placed. The shelf 40 may be composed of a plurality of shelves, on any of which foodstuffs are placed. The shelf 40 may partition the internal space of the storage compartment horizontally.

The storage compartment may be provided with a drawer 50, which is capable of being put into or drawn out of the storage compartment 11. The drawer 50 contains foodstuffs and the like. The drawer 50 may be composed of a pair of drawers, which are positioned at right and left sides in the storage compartment 12. A user may open the left door in order to access to the drawer disposed at the left side. Similarly, a user may open the right door in order to access to the drawer disposed at the right side.

The partition wall 15 may be provided with a space for containing foodstuffs. The space may be referred to as a multi-receiving compartment or a receiving unit P. The partition wall 15 may be constructed separately from the doors 20 and 30. Accordingly, the partition wall 15 may remain in place without moving even when the doors 20 and 30 are rotated. Consequently, a user may reliably put foodstuffs into the storage compartment by virtue of the receiving unit P, or may reliably take the foodstuffs out of the storage compartment by virtue of the receiving unit P.

The storage compartment 11 may be partitioned into a plurality of spaces for storing foodstuffs, that is, a space positioned above the shelf 40, a space defined by the drawer 50, and the receiving unit P, defined by the partition wall 15.

The receiving unit P may be depressed downwards from the partition wall 15, which defines the lower surface of the storage compartment 11. In other words, the receiving unit P may be formed by reducing the thickness of the partition wall 15 somewhat. Accordingly, the internal volume of the storage compartment 11 may be increased by virtue of the receiving unit P.

Cold air supplied to the storage compartment 11 may be introduced into all of the spaces defined in the single storage compartment 11. Specifically, since cold air is able to flow among the spaces, the spaces may be considered to be conceptually different from the above-described storage compartments.

Specifically, unlike the storage compartments which define insulated spaces, the spaces are not insulated from each other, although there may be a temperature difference between the spaces.

Cold air supplied to one of the storage compartments cannot flow into another storage compartment but can freely flow into any of the spaces defined in the storage compartment. In other words, cold air, which is positioned above the shelf 40, may flow into the space defined by the drawer 50.

The refrigerating compartment door 20 may be provided therein with a plurality of baskets 80. The plurality of baskets 80 may be disposed at different heights from each other, and foodstuffs may be stored in the internal space defined in the baskets 80.

A gap G may be defined between the upper surface of the partition wall 15, that is, the lower surface of the storage compartment 11 and a separate storage space such as the drawer 50. The gap G is intended to provide a space for allowing a receiver door, adapted to open and close a receiver to be described later, to be moved therethrough. Accordingly, the gap G may be formed at a height corresponding to the height of the receiver door having a horizontal plate shape. In other words, the gap G may have a height such that only the receiver door can be smoothly moved therethrough.

Hereinafter, the receiving unit P according to an embodiment of the present invention will be described in more detail.

Figure 2:
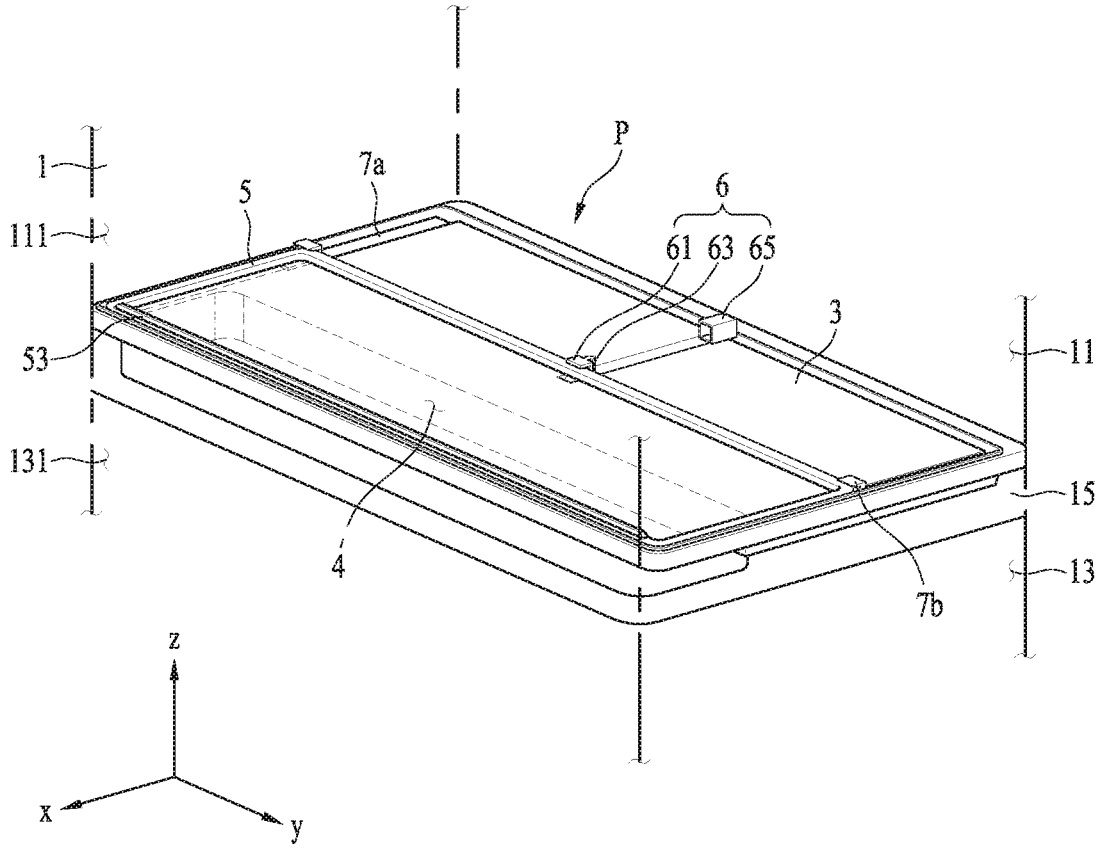
FIG. 2 illustrates a receiving unit of the refrigerator according to the embodiment of the present invention.

As illustrated in FIG. 2, the refrigerator 100 according to an embodiment of the present invention may include the cabinet 1, the storage compartments, which are provided in the cabinet 1 to provide a space for receiving storage objects (objects to be refrigerated or objects to be frozen), and a heat exchange unit for exchanging heat with the internal air in the storage compartments.

The storage compartments may be provided in a plural number in the cabinet 1. FIG. 2 illustrates an example in which the storage compartment is divided into the first storage compartment 11 and the second storage compartment 13.

When the storage compartment is divided into the first storage compartment 11 and the second storage compartment 13, the first storage compartment 11 may be one of the refrigerating compartment and the freezing compartment, and the second storage compartment 13 may be the other of the refrigerating compartment and the freezing compartment. In this case, the first storage compartment 11 and the second storage compartment 13 may be separated from each other by means of the partition wall 15.

Alternatively, the first storage compartment 11 and the second storage compartment 13 may be formed by dividing one refrigerating compartment or freezing compartment into two compartments using the partition wall 15.

Each of the storage compartments 11 and 13 has to be provided with an open surface through which storage objects are taken out of the cabinet 1. Specifically, the first storage compartment 11 may communicate with the outside through a first open surface or a first opening 111, and may communicate with the outside through a second open surface or a second opening 131.

The first open surface 111 and the second open surface 131 may be configured to be opened and closed by the doors 20 and 30.

However, in the case in which the first storage compartment 11 and the second storage compartment 13 are isolated from each other in one refrigerating compartment or freezing compartment, the first storage compartment 11 and the second storage compartment 13 may be concurrently opened and closed by means of a single door.

The heat exchange unit may include a compressor configured to compress refrigerant, a condenser configured to cause the refrigerant discharged from the compressor to exchange heat with air outside the cabinet so as to condense the refrigerant, an expansion valve configured to reduce the pressure of the refrigerant discharged from the condenser and an evaporator configured to cause the refrigerant passed through the expansion valve to exchange heat with air in the storage compartments so as to evaporate the refrigerant. Since the evaporator absorbs heat from the air in the storage compartments, the air circulating in the storage compartments is cooled while passing through the evaporator. By virtue of this procedure, the heat exchange unit is able to control the temperature of the first storage compartment 11 and the second storage compartment 13 so as to be lower than the ambient temperature.

The partition wall 15, which divides the internal space of the refrigerator into the first storage compartment 11, that is, the first space, and the second storage compartment 13, that is, the second space, is provided with the receiving unit P. The receiving unit P may include the receiver 4, which is depressed downwards from the partition wall 15 so as to define a space for receiving storage objects, and the receiver door 5 configured to be moved in a direction parallel to the upper surface of the partition wall 15.

The receiver 4 may be formed in the partition wall 15 itself, or may be formed in a receiver body 3 coupled to the partition wall 15. When the receiver body 3 is coupled to an upper portion of the partition wall 15, the receiver body 3 may be made of a material different from that of the partition wall 15.

Any structure may be considered to be the partition wall 15 as long as the structure has a predetermined thickness (a length in the height direction of the cabinet, that is, a length in the z-axis direction) so as to divide the storage space into two spaces.

When the first storage compartment 11 is one of the refrigerating compartment and the freezing compartment and the second storage compartment 13 is the other of the refrigerating compartment and the freezing compartment, the partition wall 15 may include an insulator, and the receiver body 3 may define the upper surface of the partition wall 15.

However, if the first storage compartment 11 and the second storage 13 are spaces resulting from the division of a single refrigerating compartment or freezing compartment, the receiver body 3 may serve as the partition wall 15 because there is no necessity to provide the insulator.

Hereinafter, the case in which the receiver body 3 defines the upper surface of the partition wall 15 will be described for convenience of explanation.

As illustrated in FIG. 2, the receiver 4 may be a space that is formed by depressing the surface of the receiver body 3 toward the second storage compartment 13. Storage objects may be introduced into the receiver 4 through an introduction port or opening 41 formed in the upper surface of the receiver 4. The receiver 4 may be positioned at the front surface of the receiver body 3, which faces the door of the cabinet. In other words, the receiver 4 may be formed in the front side of the lower surface of the first storage compartment 11.

When the receiving unit P according to an embodiment of the present invention is provided at the partition wall 15, an additional component such as the above-described shelf 40 or the drawer 50 may further be provided above and close to the receiving unit P. In this case, if the gap between the receiving unit P and the additional component is small, a user may easily put a storage object into the receiver 4 or may easily take the storage object out of the receiver 4 only when the receiver 4 is positioned at a front side of the first storage compartment 11.

Specifically, the shelf 40 or the drawer 50 may be disposed above a rear side of the receiving unit P, rather than being disposed directly above the receiving unit P. A gap G may be defined between the receiving unit P and the shelf 40 or the drawer 50.

The receiver 4 may be composed of a receiving groove, which is integrally formed in the receiver body 3, or may be composed of the receiving groove and a tray, removably coupled to the receiving groove.

In the case in which the receiver 4 is composed of the receiving groove and the tray, it is possible for a user to take the tray out through the introduction port 41 and to wash the tray when it is a necessary to wash the receiver 4, thereby providing an effect of enabling the receiver 4 to be easily cleaned compared to the case in which the receiver 4 is composed only of the receiving groove.

When the receiver body 3 is configured to form the upper surface of the partition wall 15, there is no need to provide an additional space for mounting the receiver 4 because the receiver 4 is embedded in the partition wall 15.

Specifically, when the receiver body 3 forms the upper surface of the partition wall 15 and the receiver 4 is positioned in the partition wall 15, the receiving unit P according to an embodiment of the present invention may be mounted in the storage compartment 11 without reducing the sizes of the storage compartments 11 and 13, which have limited internal spaces. In other words, it is possible to increase the overall internal space.

That it is possible to mount the receiver 4 without reducing the internal space in the storage compartments 11 and 13 indicates that it is possible to add space for receiving storage objects without changing the volume or the number of the components (the drawer, the shelf or the like), which is mounted in the storage compartments 11 and 13 so as to receive storage objects. Accordingly, if the receiver body 3 is configured to form the upper surface of the partition wall 15 (i.e., the receiving unit is provided at the partition wall), there is an effect of maximizing the efficiency of storage.

The receiver door 5, which is intended to open and close the introduction port 41 formed in the receiver, may include a door body 51 capable of being moved along the surface of the receiver body 3. The door body 51 may be provided with a handle 53.

The receiver 4 is depressed downwards, and the introduction port 41 is formed in the upper surface of the receiver. Accordingly, introduction and removal of foodstuffs through the introduction port 41 is performed vertically. The movement of the receiver door for opening and closing the introduction port 41 is performed vertically. Accordingly, the direction of introduction of foodstuffs may be perpendicular to the direction of movement of the receiver door 5.

Generally, each of the storage compartments 11 and 13 of the refrigerator may be provided with the drawer 50, which is drawn out of the storage space so as to receive storage objects, or may be provided with the shelves 40, which are arranged in a vertical direction and are secured to the inside of the storage space so as to support storage objects.

Accordingly, the drawer or the shelf may be provided above the receiving unit P. Here, in the case in which the receiver door 5 is coupled to the receiver body 3 so as to be rotated toward the drawer or the shelf positioned thereabove, it is possible to put storage objects into the receiver 4 or to take the storage objects out of the receiver 4 only when the distance between the receiving unit P and the drawer or the shelf is larger than the radius of rotation of the receiver door 5.

If there is a need to change the height of the drawer or the shelf in order to mount the receiving unit P, this means that the storage space is reduced. Accordingly, the configuration, in which the introduction port 41 of the receiving unit P is opened and closed by means of the door body 51, which is capable of being moved in a direction parallel to the surface of the receiver body 3, is intended to minimize the internal space required to mount the receiver P.

An embodiment of the present invention may include a position holder or latch 6 capable of holding the state in which the door body 51 opens the introduction port 41. The embodiment of the present invention may include transfer units or closers 7*a* and 7*b*, which provide the door body 51 with force capable of moving the door body 51 in conjunction with or independently of the position holder 6 in the direction in which the introduction port 41 is closed.

Figure 3:
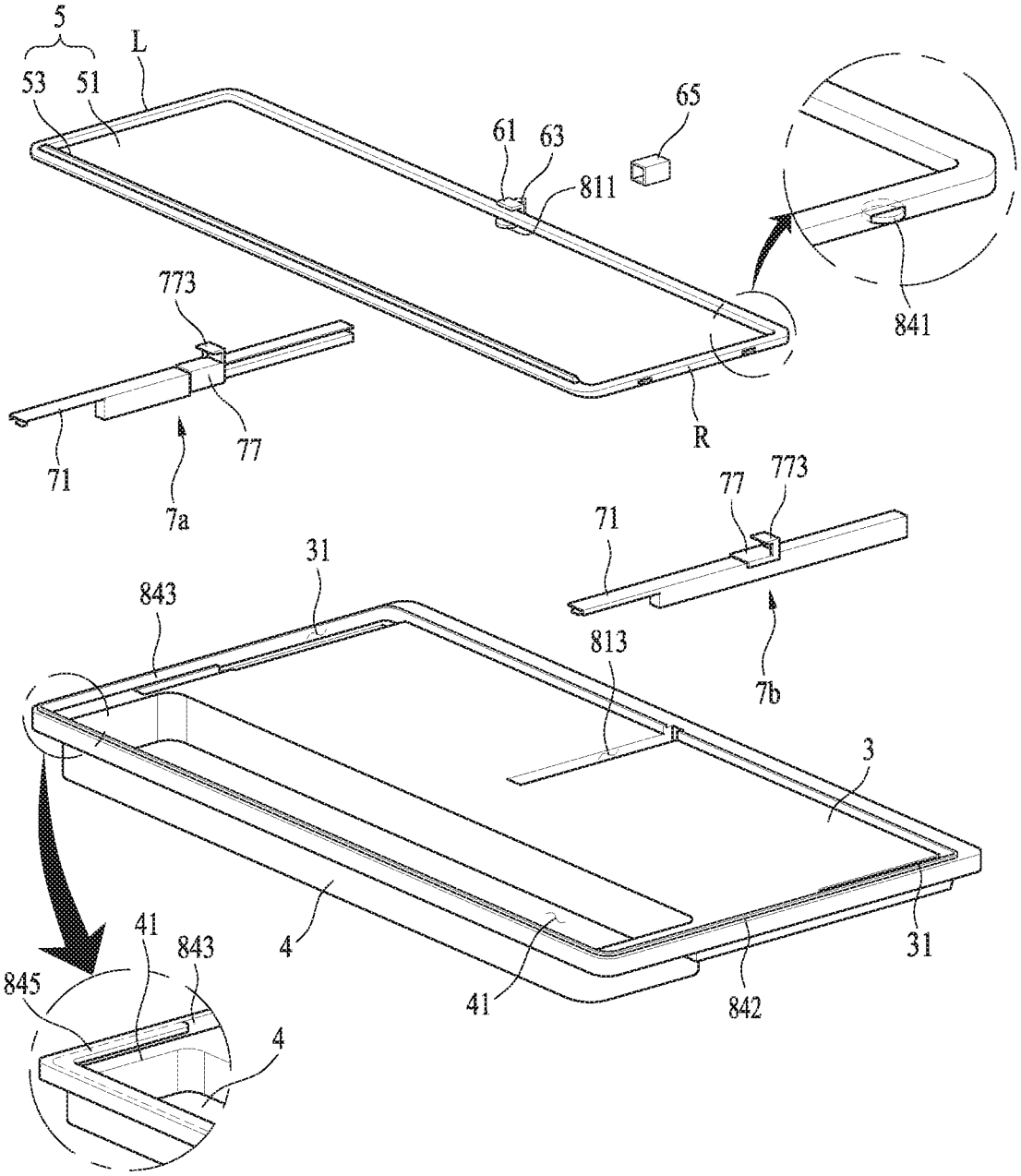
FIG. 3 illustrates the receiving unit according to the embodiment of the present invention.

The position holder 6 may include a coupling body 61 coupled to the door body 51, a coupling protrusion 63 provided at one of the receiver body 3 and the coupling body 61, and a coupling grab or coupling retainer 65 provided at the other of the receiver body 3 and the coupling body 61 so as to be removably engaged with the coupling protrusion 63. FIG. 3 illustrates an example in which the coupling protrusion 63 is provided at the coupling body 61 and the coupling grab 65 is secured to the receiver body 3.

Figure 4:
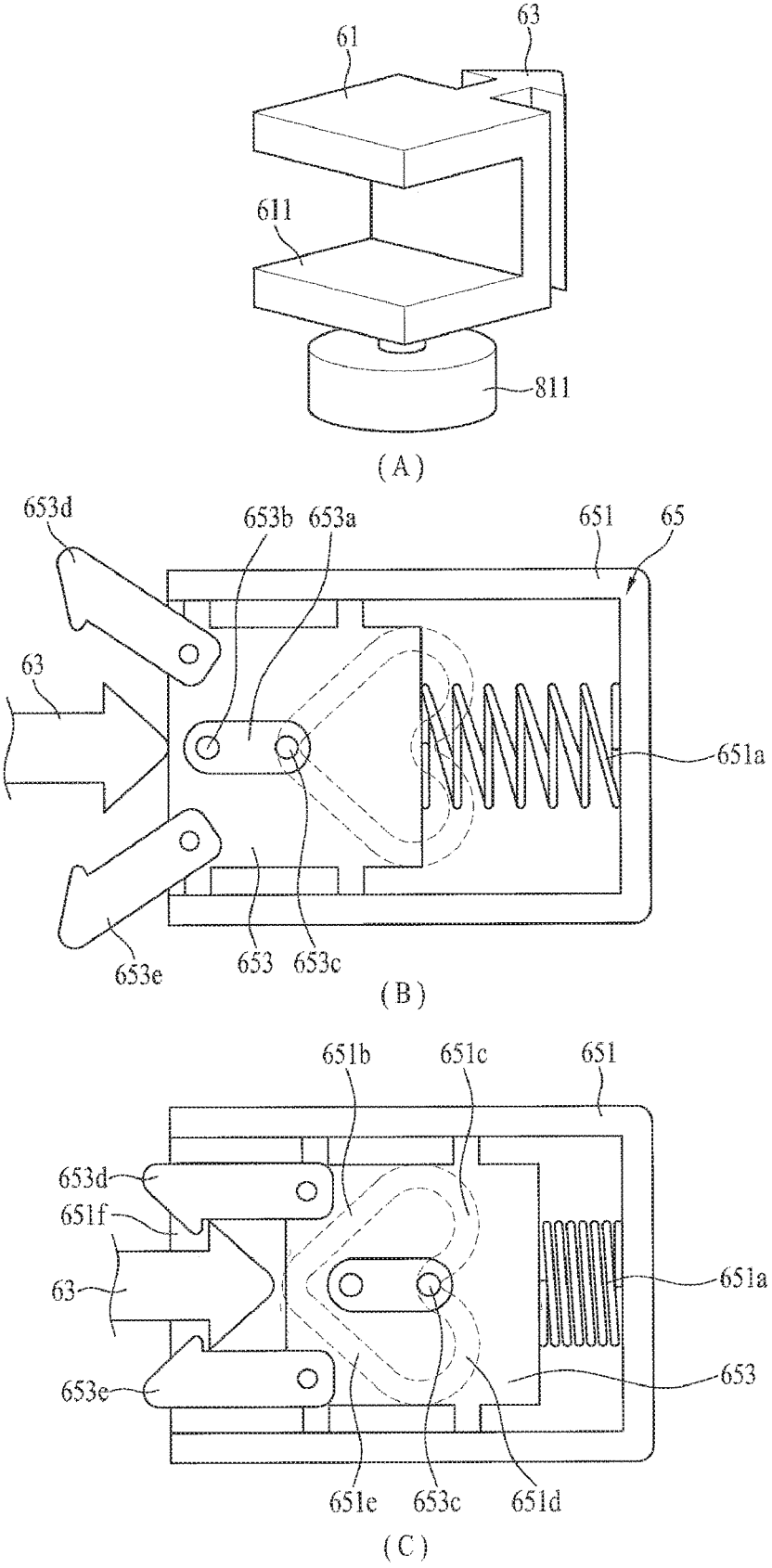
FIG. 4 illustrates an example of a position holder provided at the receiving unit shown in FIG. 3.

As illustrated in FIG. 4, the coupling body 61 may be provided with a coupling portion 611 into which the door body 51 is fitted. Here, since the peripheral edge of the door body 51 is fitted into the coupling portion 611 and is thus secured to the coupling body 61, the coupling body 61 will be moved in conjunction with the door body 51.

The coupling portion 65 may be configured to be repeatedly engaged with or released from the coupling protrusion 63 whenever external force is applied to the coupling protrusion 63. FIG. 4B illustrates an example of the coupling portion 65 for realizing the above function.

As illustrated in FIG. 4B, the coupling grab 65 may include a first coupling grab body 651, secured to the receiver body 3, and a second coupling grab body 653, which is disposed in the first coupling grab body 651 so as to reciprocate therein and is removably engaged with the coupling protrusion 63.

The first coupling grab body 651 may include a fitting gate 651*f* into which the second coupling grab body 653 is fitted, a spring 651*a* for supplying elastic force to the second coupling grab body 653, and moving path sections 631*b*, 631*c*, 631*d* and 631*e*, which guide the movement of the second coupling grab body 653.

The spring 651*a* serves to push the second coupling grab body 653 toward the fitting gate 651*f*.

As illustrated in FIG. 3C, the moving path of the second coupling grab body 653 may include a first path section 651*b*, which extends toward the bottom surface of the first coupling grab body 651 (in a direction away from the fitting gate) from the fitting gate 651*f*, a second path section 651*c*, extending toward the fitting gate 651*f* from one end of the first path section, a third path section 651*d*, extending toward the bottom surface of the first body 631 from the second path section, and a fourth path section 651*e*, extending toward the fitting gate 651*f* from the third path section 651*d* and connected to the other end of the first path section 651*b*.

Here, the second coupling grab body 653 may include a bar 653*a*, rotatably coupled to the second coupling grab body via a shaft 653*b*, a protrusion 653*c*, provided at the bar so as to be inserted into the path sections 651*b*, 651*c*, 651*d* and 651*e*, and a first bar 653*d* and a second bar 653*e*, which are rotatably coupled to the second coupling grab body 653 and are exposed to the outside of the first coupling grab body 651 through the fitting gate 65 if.

Accordingly, when the door body 51 is moved in the posterior direction of the first space 11 (when the door body is moved so as to open the introduction port), the coupling protrusion 63 moves the second coupling grab body 653 toward the bottom surface of the first coupling grab body 651.

When the second coupling grab body 653 is pushed, the protrusion 653*c* is moved along the first path section 651*b* and the second path section 651*c* and is positioned at the connecting point (first point) between the second path section 651*c* and the third path section 651*d*, and the first bar 653*d* and the second bar 653*e* are rotated toward the coupling protrusion 63 while interfering with the fitting gate 651*f*. Consequently, when the protrusion 653*c* provided at the second coupling grab body is positioned at the first point, the coupling protrusion 63 is held on the second coupling grab body 653, and the door body 51 is maintained in the state of opening the introduction port 41.

In this state, when a user pushes the door body 51 toward the rear surface of the first space 11 once more, the coupling protrusion 63 pushes the second coupling grab body 653, and the protrusion 653*c* is thus moved to the connecting point (second point) between the fourth path section and the first path section 651*b* through the third path section 651*d* and the fourth path section 651*e*.

When the protrusion 653*c* provided at the second coupling grab body is positioned at the second point, the coupling protrusion 63 is released from the second coupling grab body 653. Accordingly, the door body 51 is moved in the forward direction of the first space 11 by means of the transfer unit 7*a* and 7*b*, thereby closing the introduction port 41.

Each of the transfer units 7*a* and 7*b* may include an elastic-force provider or elastic-spring 75 configured to provide the door body 51 with restoring force (force capable of moving the door body toward the introduction port when the external force applied to the door body is released) when the door body 51 is moved so as to open the receiver 4. Each of the transfer units 7*a* and 7*b* may include a speed controller 76 for controlling the moving speed of the door body 51 when the door body 51 is moved in conjunction with or independently of the elastic-force provider 75 so as to close the receiver 4.

Figure 5:
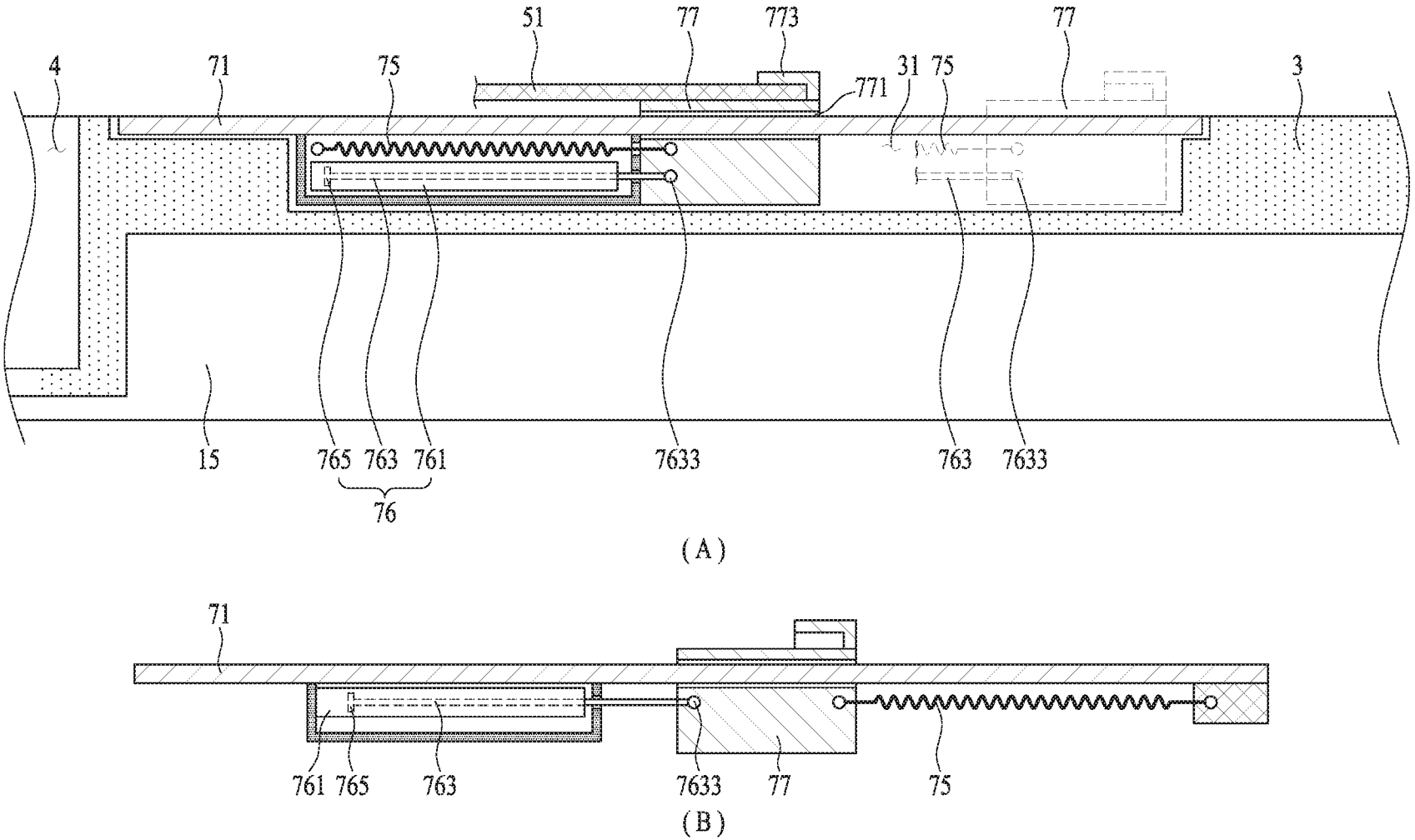
FIG. 5 illustrates an example of a transfer unit according to an embodiment of the present invention.

The elastic-force provider 75 and the speed controller 76 may be configured to directly connect the door body 51 to the body 3, or may be configured to connect the support 71 to the slider 77 which is moved together with the door body 51, as illustrated in FIG. 5.

The support 71, which is provided in a direction parallel to the direction of movement of the door body 51 so as to provide the moving path of the slider 77, may be secured to the receiver body 3.

The slider 77, which is reciprocated in the slider recess 31 formed in the body 3 in a direction parallel to the direction of movement of the door body 51, may include a through hole 771 into which the support 71 is inserted, and a door coupler 773 coupled to the door body 51.

The elastic-force provider 75 may be composed of a tensile spring, which is connected to both the support 71 and the slider 77 so as to provide restoring force capable of moving the door body 51 so as to close the receiver 4.

Alternatively, the elastic-force provider 75 may be composed of a compression spring. The elastic-force provider 75, which is composed of the compression spring, has to be configured to push the slider 77 toward the receiver 4, as illustrated in FIG. 5.

Accordingly, the door body 51, which has been moved so as to open the receiver 4, is moved toward the first opening 111 so as to close the receiver 4 by means of the elastic-force provider 75 when the coupling protrusion 63 is released from the coupling grab 65.

If the restoring force provided to the door body 51 by the elastic-force provider 75 is excessive, there are risks of the door body 51 being damaged due to collision with the receiver body 3 and of a user's hand colliding with the door body 51. The speed controller 76 according to an embodiment of the present invention is able to solve the above-described problems by reducing the speed of movement of the door body 51 when the door body 51 is moved so as to close the introduction port 41.

As illustrated in FIG. 5, the speed controller 76 may include a cylinder 761 secured to the support 71, a piston, which is disposed at one end thereof in the cylinder and is connected at the free end thereof to the slider 77, and a head 765 secured to the one end of the piston and disposed in the cylinder 761.

The speed controller 76 may be configured to increase the extension distance of the piston 763 as the door body 51 is moved so as to open the introduction port 41 (as the coupling protrusion 63 is moved toward the coupling grab 65).

The speed controller 76, which has the above structure, may reduce the moving speed of the door body 51 when the door body 51 is moved so as to open the introduction port 41 and the door body 51 is moved so as to close the introduction port 41.

As illustrated in FIG. 3, the transfer units, which have the above structure, may be respectively provided at opposite lateral side edges of the door body 51. The reason for this is to prevent the occurrence of a problem in which the movement of the door body 51 is stopped because the distance of movement of one of opposite lateral ends of the door body 51, which are parallel to the direction of movement of the receiver door 5, is different from the distance of movement of the other of the opposite lateral ends of the door body 51.

Assuming that a single transfer unit is provided so as to support the center of the door body 51, when a user pushes the door body 51 in the rearward direction of the first storage compartment 11 at a point deviating from the center of the door body 51, the moving distance of the left lateral end L may be different from the moving distance of the right lateral end R. If the moving distances of the left and right lateral ends are different from each other, a problem in which the door 51 cannot be moved or in which a lot of force is required to move the door body 51 may occur.

However, when the transfer units 7*a* and 7*b* are respectively provided at the left lateral end L and the right lateral end R of the door body 51, it is possible to prevent the above problem in which the door body 51 is inclined when a user pushes the door body at a point deviating from the center of the door body 51.

In order to prevent the door body 51 from being slanted, an embodiment of the present invention may further include a guide 8 for guiding the movement of the door body 51.

As illustrated in FIG. 3, the guide 8 may further include at least one of first guides 811 and 813, disposed between the two transfer units 7*a* and 7*b*, and second guides 842 and 843, which are respectively provided at opposite lateral ends L and R of the door body 51, which is parallel to the direction of movement of the receiver door 5. The guide 8 may be provided at the center of the receiver door 5 in a lateral direction.

The transfer units 7*a* and 7*b* are configured to generate elastic force and/or damping force when the force applied to the receiver door 5 by a user is released. In other words, the transfer units 7*a* and 7*b* are configured not only to guide movement of the receiver door 5 through the transfer units but also to provide elastic force and/or damping force to the receiver door 5. However, the guide 8 may be configure so as not to provide elastic force or damping force to the receiver door 5. In other words, the guide 8 may be configured to guide the anteroposterior movement of the transfer-unit door 50 at the center of the transfer-unit door 5 in a lateral direction.

The first guide may include a roller 811, rotatably provided in the door body 51, and a roller-receiving groove 813 provided in the receiver body 3 so as to receive the roller.

The roller 811 may be disposed at any location on the door body 51, as long as the roller is disposed between the pair of transfer units 7*a* and 7*b*. FIG. 3 illustrates an example in which the roller (first roller) 811 is positioned at the center of the door body 51.

In this case, the first roller 811 may be rotatably secured to the coupling body 61 positioned at the center of the door body 51, and the roller-receiving groove 813 may be formed by depressing the surface of the receiver body 3.

Each of the second guides may include a roller (second roller) 841, rotatably secured to opposite lateral ends L and R of the door body 51, which are parallel to the direction of movement of the receiver door 5, and a support wall 843 provided at one of opposite lateral ends, which is parallel to the direction of movement of the receiver door 5, so as to support the second roller 841.

The support wall may be composed of a rib projecting from the peripheral edge of the receiver body 3. The support wall 843 may further include a cover defining a space for receiving the peripheral edge portion of the door body 51.

Since the cover 845 is made of a plate extending toward the door body 51 from the support wall 843 so as to support the front peripheral edge of the door body 51, the present invention is able to prevent the door body 51 from being separated from the receiver body 3 by virtue of the cover 845.

Figure 6:
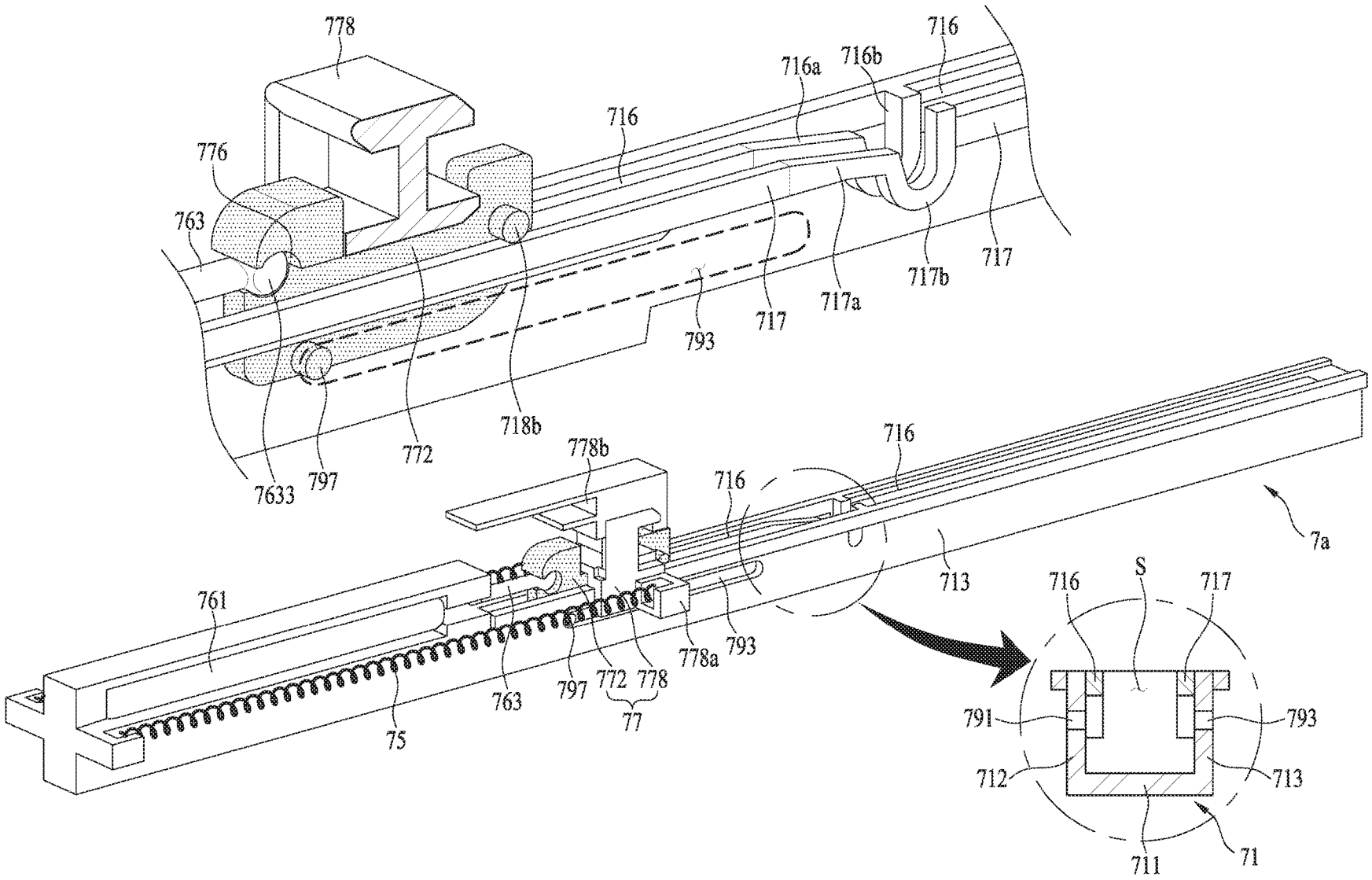
FIGS. 6, 7 and 8 illustrate another embodiment of the transfer unit according to an embodiment of the present invention.
Figure 7:
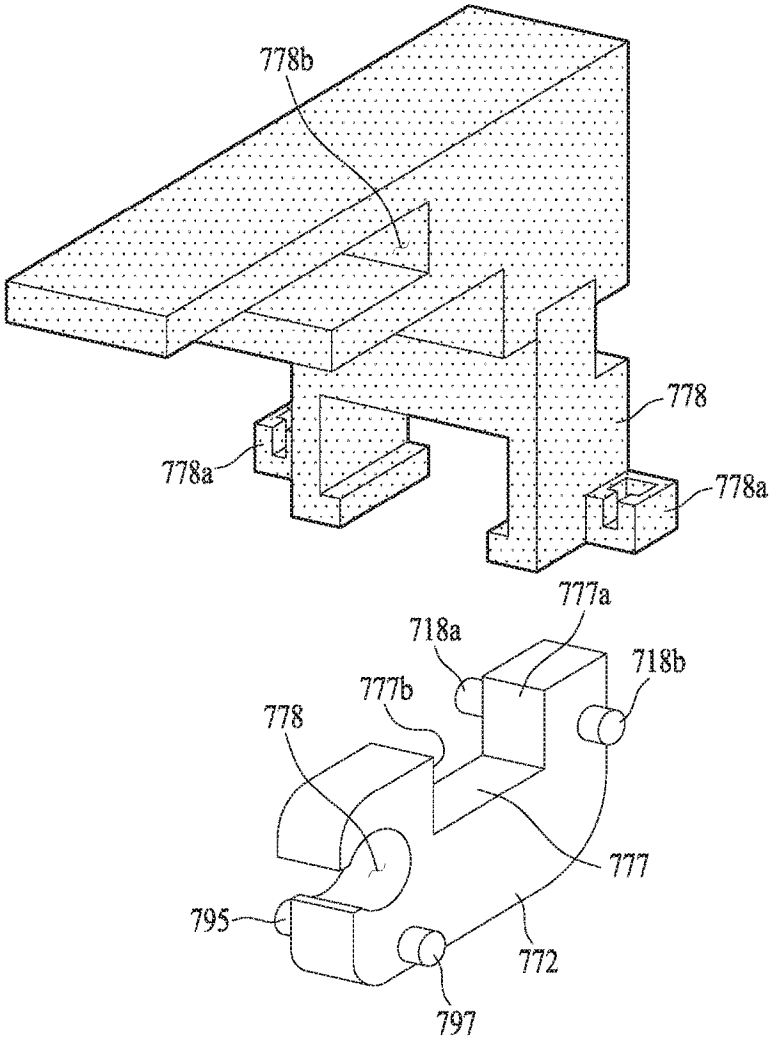
Figure 7:
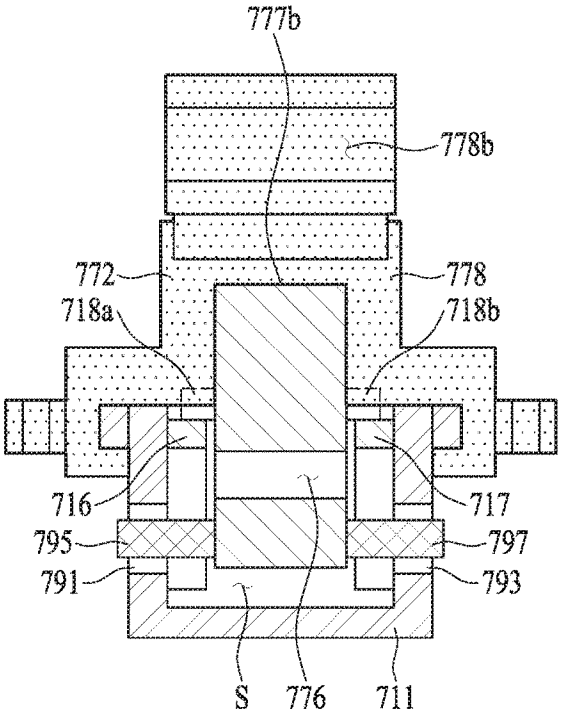
Figure 8:
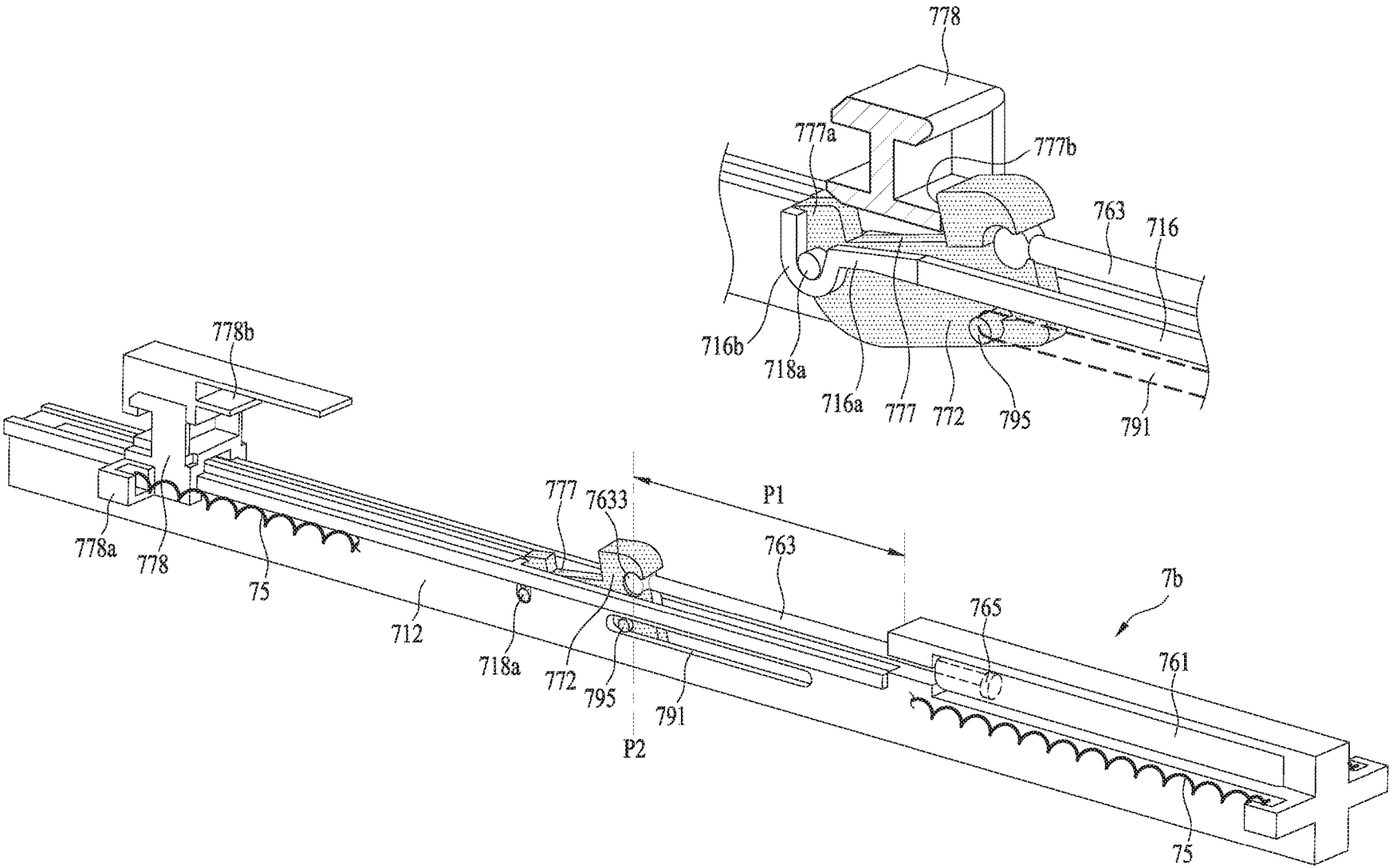

FIGS. 6 to 8 illustrate another embodiment of the transfer unit according to an embodiment of the present invention. Each of the transfer units 7*a* and 7*b* according to this embodiment may include a support 71 extending in a direction parallel to the direction of movement of the door body 51, a transfer space S, which is parallel to the direction of movement of the door body 51, a first slider 772, which is movable in the transfer space and is connected to the free end 7633 of the piston, and a second slider 778, which is connected to the door body 51 and is secured to one end of the elastic-force provider 75.

The second slider 778 is characterized by being separated from the first slider 772 depending on whether the free end 7633 of the piston passes over a predetermined reference point P2 (see FIG. 8).

The support 71 may include a base 711, secured in a slider recess 31 provided in one of opposite lateral ends the receiver body and secured to the body 3 so as to be parallel to the direction of movement of the door body 51, and a first side wall 712 and a second side wall 713, which are provided at opposite lateral ends of the base 711 parallel to the direction of movement of the door body 31 (the x-axis direction). Here, the transfer space S is defined by the base 711, the first side wall 712 and the second side wall 713.

The transfer space S is provided therein with a first support 716 and a second support 717, which are spaced apart from each other by a predetermined distance so as to provide the moving path of the first slider 772. Here, the first slider 772 is positioned between the first support 716 and the second support 717, and is connected to the free end 7633 of the piston via a piston coupler 776.

As illustrated in FIG. 7, the first slider 772 may include a mount portion 777 in which the second slider 778 is received. The mount portion 777 may be defined by a first stopper 777*a* and a second stopper 777*b*, which are spaced apart from each other so as to receive the second slider 778.

The first stopper 777*a* may be defined as a stopper, which is positioned in a direction in which the second slider 778 is separated from the first slider 772, and the second stopper 777*b* may be defined as a stopper closer to the free end 7633 of the piston.

The second slider 778 may include a door coupler 778*b* coupled to the door body 51 and a spring coupler 778*a* secured to an end of the elastic-force provider 75.

In the transfer units 7*a* and 7*b* having the above-described structure, the second slider 778 may be separated from the first slider 772 by means of height controllers 716*a*, 716*b*, 717*a*, 717*b*, 718*a* and 718*b*.

As illustrated in FIGS. 6 and 8, the height controllers may include a first projection 718*a* (see FIG. 8), which projects from the first slider 772 so as to cause the first slider 772 to be supported by the first support 716, a second projection 718*b*, which projects from the first slider 772 so as to cause the first slider to be supported by the second support 717, a first receiving groove 716*b* formed at a position lower than the first support 716 so as to receive the first projection 718*a* therein, a second receiving groove 717*b* formed at a position lower than the second support 717 so as to receive the second projection 718*b* therein, a first sloped portion 716*a* inclined downwards toward the first receiving groove from the first support 716, and a second sloped portion 717*a* inclined downwards toward the second receiving groove 717*b* from the second support 717.

As illustrated in FIG. 8, when the free end 7633 of the piston reaches the reference point P2, the height controllers move the first projection 718*a* and the second projection 718*b* to the first receiving groove 716*b* and the second receiving groove 717*b*, thereby lowering the first stopper 777*a* to a position lower than the first support 716 and the second support 717.

Since the first stopper 777*a* is the stopper that is positioned in the direction in which the second slider 778 is separated from the first slider 772, when the first stopper 777*a* is moved to a position lower than the first support 716 and the second support 717, the second slider 778 is allowed to be separated from the mount portion 777 of the first slider 772.

Accordingly, when a user pushes the door body 51 in the posterior direction of the first space 11 (in the negative x-axis direction) such that the free end 7633 of the piston passes over the reference point P2, the door body 51 is able to move together with the second slider 778 until the coupling protrusion 63 is coupled to the coupling grab 65.

When the coupling protrusion 63 is separated from the coupling grab 65, the door body 51 is moved toward the first slider 772 by means of the second slider 778, which is connected to the elastic-force provider 75. At this time, the second slider 778 collides with the second stopper 777*b* provided at the first slider. Upon collision of the second slider with the second stopper, the first projection 718*a* and the second projection 718*b* are taken out of the first receiving groove 716*b* and the second receiving groove 717*b*.

When the first projection 718*a* and the second projection 718*b* are taken out of the first receiving groove 716*b* and the second receiving groove 717*b*, the second slider moves together with the first slider toward the introduction port 41. At this time, since the first slider 772 is connected to the speed controller 76, an excessive increase in the moving speed of the door body 51 is prevented.

The reference point P2 may be set to be a point in the moving range P1 of the free end 7633 of the piston. FIG. 8 illustrates an example in which the reference point P2 is set to be the limiting point of the moving range of the free end 7633 of the piston.

The reference point P2 may be set to be the position of the free end 7633 of the piston that is located between the point at which the door body 51 begins to close the introduction port 41 and the point at which the door body 51 closes the introduction port 41 by 50%.

Assuming that the drawer or the shelf is positioned above the receiving unit P, it is advantageous for the door body 51 to be quickly moved to the reference point in terms of rapid closing of the introduction port 41. The reason for this is because, even when the door body 51 is quickly moved to the reference point, none of the above-mentioned problems caused by the high speed of the door body 51 occur.

For this reason, the reference point P2 may be set to be the position of the free end 7633 of the piston that is located between the point at which the door body 51 closes the introduction port 41 by 50% or more and the point at which the door body 51 closes the introduction port 41 by 90%.

As illustrated in FIG. 7, each of the transfer units 7*a* and 7*b* according to this embodiment may further include slider guides 791, 793, 795 and 797 configured to guide the movement of the first slider 772.

Specifically, each of the slider guides may include a first transfer groove 791, which is formed in the first side wall 712 of the support in the direction of movement of the door body 51, a second transfer groove 793, which is formed in the second side wall 713 in the direction of movement of the door body 51, a first protrusion 795, which projects from the first slider 772 and is fitted into the first transfer groove 791, and a second protrusion 797, which projects from the first slider 772 and is fitted into the second transfer groove 793.

In the above-described embodiments, the position holder 6 is positioned behind the receiver door 5. A portion of the position holder 6 may be positioned below the drawer 50 through the gap G. In other words, a portion of the position holder 6 may be positioned below the drawer 50 even when the receiver door 5 closes the introduction port 41.

When the receiver door 5 opens the introduction port 41, the receiver door 50 may be further moved through the gap G.

Accordingly, the position holder may be a structure, all of which is visible to a user or only a portion of which is visible to a user. When a user intuitively pushes the receiver door 5 rearwards, the movement of the receiver door 5 may be restricted at a certain moment. Subsequently, when a user intuitively pushes the receiver door 5 rearwards again, the movement of the receiver door 5 may be restricted.

By virtue of these characteristics, it is possible to prevent damage to the position holder 6. Furthermore, it is possible to prevent a reduction in storage space and deterioration of design due to the presence of the position holder 6. Particularly, when the receiver door 5 is made of a transparent material, it is possible to prevent deterioration in design of the receiver door 5 due to the presence of the position holder 6.

In the above embodiments, the transfer units 7*a* and 7*b* may be provided at opposite lateral ends of the receiver door, and may be disposed below the receiver door. Accordingly, it is possible to prevent a reduction in the amount of storage space, deterioration in the design of the storage compartment, and deterioration in the design of the receiver door 5 by virtue of the transfer units.

In the above embodiments, the receiver door 5 may be easily removed from the receiving unit P. Basically, the receiver door 5 may come into contact with the upper surface of the partition wall due to its own weight, and may be configured to have a horizontal plate shape so as to be moved horizontally.

The transfer units 7*a* and 7*b* and the position holder 6 may be removably coupled to the rear end of the receiver door 5.

Specifically, as illustrated in FIG. 2, each of the transfer units 7*a* and 7*b* may be provided with the door coupler 773. The position holder 6 may be provided with the coupling body 61. The door coupler and the coupling body may be configured to have a groove shape so as to receive the receiver door to the rear from the front. Accordingly, as the receiver door is moved rearwards, the receiver door pushes the transfer units and the position holder rearwards. Similarly, as the transfer units and the position holder are moved forwards, the receiver door is moved forwards.

When a user moves the receiver door vertically in the state of grasping the front portion of the receiver door and then pulls the receiver door forwards, the receiver door can be easily separated from the door coupler and the coupling body. Similarly, the receiver door can be easily coupled to the door coupler and the coupling body through the reverse manipulation.

Accordingly, a user can separate the receiver door 5 and can perform cleaning of the receiver door 5 and the receiver 4.

The present invention may be embodied so as to have various modifications, and the scope of rights thereof is not limited to the above embodiments. Accordingly, as long as the modifications thereof include the components disclosed in claims, it should be understood that such modifications are considered to fall within the scope of rights of the present invention.

INDUSTRIAL APPLICABILITY

The industrial applicability was described in the Best Mode.

The invention claimed is:

1. An apparatus comprising:

a first storage compartment;

a second storage compartment;

a partition wall provided between the first storage compartment and the second storage compartment, and the partition wall having a surface;

a receiving space formed in the surface of the partition wall, the receiving space including an introduction port, which is constituted by an opening, to allow objects to be introduced into the receiving space through the opening;

a receiver door configured to be moved in a direction parallel to the surface of the partition wall, to an open position, to allow access to the opening;

a latch to maintain the receiver door in the open position; and a closer configured to provide restoring force to the receiver door in case that the receiver door is moved to open the opening.

2. The apparatus according to claim 1, wherein the latch includes a coupling member provided at one of the receiver door and the partition wall, and a coupling retainer provided at the other one of the receiver door and the partition wall to be selectively coupled to the coupling member.

3. The apparatus according to claim 2, wherein the latch further includes a coupling body secured to the receiver door, the coupling member or the coupling retainer being provided at the coupling body.

4. The apparatus according to claim 2, wherein the coupling retainer is configured to be repeatedly engaged with the coupling member and released from the coupling member in case that external force is applied to the coupling retainer.

5. The apparatus according to claim 1, wherein the latch is provided at a center of the receiver door in a lateral direction, and the latch provided at least in part behind the receiver door.

6. The apparatus according to claim 1, wherein the latch further comprises a coupling body secured to the receiver door and a roller rotatably secured to the coupling body.

7. The apparatus according to claim 6, further comprising a roller-receiving groove provided in the partition wall behind the receiving space in a direction parallel to a direction of movement of the receiver door so as to receive the roller and to guide movement of the roller.

8. The apparatus according to claim 1, further comprising a closer configured to provide restoring force to the receiver door in case that the receiver door is moved to open the opening.

9. The apparatus according to claim 8, wherein the closer is configured to guide movement of the receiver door.

10. The apparatus according to claim 8, wherein the closer is provided at both lateral sides of the receiver door.

11. The apparatus according to claim 10, wherein the closer comprising:

an elastic-spring having a first end and a second end;

a support provided parallel to a direction of movement of the receiver door and secured to the first end of the elastic-spring; and a slider movable along the support and coupled to the receiver door, the slider being secured to the second end of the elastic-spring.

12. The apparatus according to claim 11, further comprising a speed control configured to reduce moving speed of the receiver door when the receiver door is moved to close the opening.

13. The apparatus according to claim 12, wherein the speed controller comprising:

a cylinder secured to the support;

a piston provided in the cylinder, the piston having a piston first end and a piston second end, and the piston second end connected to the slider; and a head secured to the piston first end, and the head provided in the cylinder.

14. The apparatus according to claim 8, further comprising guides provided between the closers, the guides including a respective guide provided at both lateral ends of the receiver door so as to guide anteroposterior movement of the receiver door.

15. The apparatus according to claim 1, the surface of the partition wall being an upper surface, and wherein the receiving space is provided at a front side of the upper surface, and an anteroposterior length of the receiver door is greater than an anteroposterior length of the opening such that the receiver door covers an entire anteroposterior length of the opening.

16. The apparatus according to claim 15, wherein the receiver door is configured to be slidably moved anteroposteriorly along the upper surface of the partition wall, and an anteroposterior length of the receiver door is smaller than an anteroposterior length of the first storage compartment.

17. The apparatus according to claim 15, further comprising:

a support wall projecting upwards from an upper surface of the partition wall, the support wall extending anteroposteriorly so as to be parallel to a direction of movement of the receiver door; and a roller rotatably provided on the receiver door so as to roll along the support wall.

18. The apparatus according to claim 1, wherein a receiving unit is provided at a rear side of the opening, the receiving unit including a shelf or a drawer.

19. The apparatus according to claim 18, wherein the receiver door is configured to be moved rearwards through a vertical gap between the upper surface of the partition wall and the receiving unit.

20. An apparatus comprising:

a first storage compartment;

a second storage compartment;

a partition wall provided between the first storage compartment and the second storage compartment, and the partition wall having a surface;

a receiving space formed in the surface of the partition wall, the receiving space including an introduction port, which is constituted by an opening, to allow objects to be introduced into the receiving space through the opening;

a receiver door configured to be moved in a direction parallel to the surface of the partition wall, to an open position to allow access to the opening;

a pair of closers, which are respectively provided at lateral side ends of the partition wall so as to guide movement of the receiver door, the pair of closers being configured to provide restoring force when the receiver door is opened; and a guide provided between the pair of closers so as to guide movement of the receiver door.

* * * * *